US008944967B2

(12) United States Patent
Kramer et al.

(10) Patent No.: US 8,944,967 B2
(45) Date of Patent: Feb. 3, 2015

(54) TREADMILL

(76) Inventors: Bruce Elliot Kramer, Potomac, MD (US); Joy Elizabeth Belin, Potomac, MD (US)

( * ) Notice: Subject to any disclaimer, the term of this patent is extended or adjusted under 35 U.S.C. 154(b) by 1764 days.

(21) Appl. No.: 10/033,775

(22) Filed: Jan. 3, 2002

(65) Prior Publication Data

US 2003/0125164 A1 Jul. 3, 2003

(51) Int. Cl.
*A63B 22/02* (2006.01)
*A63B 21/28* (2006.01)

(52) U.S. Cl.
CPC ..... *A63B 22/0242* (2013.01); *A63B 21/285* (2013.01); *A63B 2208/14* (2013.01); *A63B 2210/50* (2013.01)
USPC ..... 482/54

(58) Field of Classification Search
USPC ..... 482/51, 54, 71; 119/702; 600/529
See application file for complete search history.

(56) References Cited

U.S. PATENT DOCUMENTS 4,087,088 A * 5/1978 Kelso ..... 472/91
4,204,673 A * 5/1980 Speer, Sr. ..... 482/5
4,342,452 A * 8/1982 Summa ..... 482/54
4,423,864 A * 1/1984 Wiik ..... 472/91
4,919,416 A 4/1990 DeCloux
4,938,469 A * 7/1990 Crandell ..... 482/54
5,162,029 A * 11/1992 Gerard ..... 482/71
5,336,146 A * 8/1994 Piaget et al. ..... 482/54
5,385,520 A * 1/1995 Lepine et al. ..... 482/54
5,607,376 A * 3/1997 Magid ..... 482/54
5,626,539 A * 5/1997 Piaget et al. ..... 482/54
5,857,942 A * 1/1999 Moon et al. ..... 482/54
5,913,684 A * 6/1999 Latham et al. ..... 434/247
6,058,888 A * 5/2000 Nichols ..... 119/702
6,162,151 A * 12/2000 Tani et al. ..... 482/54
6,228,037 B1 * 5/2001 Derksen ..... 600/529
6,273,844 B1 * 8/2001 Kelsey et al. ..... 482/54
6,461,279 B1 * 10/2002 Kuo ..... 482/54
6,749,541 B1 * 6/2004 Martin ..... 482/54
6,837,830 B2 * 1/2005 Eldridge ..... 482/54
7,462,139 B2 * 12/2008 Stafiej et al. ..... 482/70
7,513,832 B2 * 4/2009 Gallagher ..... 472/89

OTHER PUBLICATIONS

NodicTrack® Teton specifications sheet (Model #NTHK2249 Rev. Mar. 23, 2000).
NordicTrack® APEX6100 specifications sheet (Model #NTTL2299 Rev. Oct. 26, 1999).
Scene from the introduction of *The Jetsons* television show showing George Jetson walking his dog Astro on a treadmill (exact date unknown, but from sometime before 1988).

* cited by examiner

*Primary Examiner* — Stephen Crow

(57) ABSTRACT

A treadmill includes a base, a pair of parallel, spaced rollers rotatably disposed in the base, and an endless belt extending around both rollers, wherein the belt has a width which is large enough to accommodate two treadmill users side-by-side. The two treadmill users can be, for example, two adult people, or an adult person and a dog.

8 Claims, 2 Drawing Sheets

TREADMILL

FIELD OF THE INVENTION

The present invention relates to a treadmill. More particularly, the present invention relates to a treadmill which can be used simultaneously by two treadmill users side-by-side.

BACKGROUND OF THE INVENTION

In recent years, many people have begun exercising more to improve their health. One popular type of exercise is walking. To make walking more enjoyable, many people walk with a partner. For example, a husband and wife may take a walk together. As another example, a person may take a walk with a dog.

However, people who enjoy walking with a partner have problems when they wish to walk at night or when the weather is poor, such as when it is raining or snowing or just simply cold. In such situations, these people face danger or discomfort or both when they walk outdoors.

To avoid these problems, people can choose to walk indoors on a treadmill. However, current treadmills in the art do not provide a satisfactory solution for people who wish to walk with a partner.

In particular, a typical treadmill can only accommodate a single treadmill user. Thus, if a person wishes to walk with a partner, two separate treadmills typically would be needed. However, such a solution is expensive. Further, even if cost were not an issue, such a solution might still be unsatisfactory, because separate treadmills can present other problems, such as making it difficult for the two treadmill users to hold hands while walking.

To solve the problem with the cost of having two of the same machines, U.S. Pat. No. 4,919,416 describes dual facing aerobic exercise machines which include diametrically opposed exercise stations provided on a common base so that diametrically opposed users can have an unobstructed view of each other and so that common components can serve each station. U.S. Pat. No. 4,919,416 discloses that the dual facing machines provide for diametrically opposed users in a close relationship so that both social as well as face-to-face competitive exercise is achievable. U.S. Pat. No. 4,919,416 further discloses that the dual facing machines include dual treadmill devices.

However, the dual facing machines disclosed in U.S. Pat. No. 4,919,416 still have a number of problems. One problem is that the cost is still high, because the design is complicated and still involves a large number of duplicate parts. In addition, problems arise from the dual facing design itself. For example, it is difficult, if not impossible, for the two treadmill users to hold hands while walking. Also, in the case where a treadmill user wishes to walk a dog, such cannot be done in the usual manner.

Thus, there is still a need in the art to provide a treadmill which can simultaneously accommodate two treadmill users side-by-side in a satisfactory manner.

SUMMARY OF THE INVENTION

One object of the present invention is to provide a treadmill which can simultaneously accommodate two treadmill users side-by-side in such a manner that the two treadmill users are able to hold hands comfortably.

Another object of the present invention is to provide a treadmill which can simultaneously accommodate a person and a dog side-by-side such that both can use the treadmill in a manner similar to the person walking the dog outdoors.

Still another object of the invention is to provide a treadmill which can simultaneously accommodate two treadmill users side-by-side in a cost-effective manner.

These and other objects are satisfied by the present invention, which provides a treadmill comprising a base, a pair of parallel, spaced rollers rotatably disposed in the base, and an endless belt extending around both rollers, wherein the belt has a width which is large enough to accommodate two treadmill users side-by-side.

The present invention also provides a treadmill comprising a base, two pairs of parallel, spaced rollers rotatably disposed in the base, and two endless belts, wherein one belt extends around both rollers in one pair of rollers and the other belt extends around both rollers in the other pair of rollers, wherein each belt has a width which is large enough to accommodate one treadmill user, and wherein the two belts are positioned to accommodate two treadmill users side-by-side.

In addition, the present invention provides a method for two treadmill users to exercise side-by-side on a single treadmill, comprising (1) providing a treadmill comprising a base, a pair of parallel, spaced rollers rotatably disposed in the base, and an endless belt extending around both rollers, wherein the belt has a width which is large enough to accommodate two treadmill users side-by-side, and (2) moving the belt to exercise two treadmill users positioned side-by-side on the belt.

Also, the present invention provides a method for two treadmill users to exercise side-by-side on a single treadmill, comprising (1) providing a treadmill comprising a base, two pairs of parallel, spaced rollers rotatably disposed in the base, and two endless belts, wherein one belt extends around both rollers in one pair of rollers and the other belt extends around both rollers in the other pair of rollers, wherein each belt has a width which is large enough to accommodate one treadmill user, and wherein the two belts are positioned to accommodate two treadmill users side-by-side, and (2) moving the belts to exercise two treadmill users positioned side-by-side on the belts.

DETAILED DESCRIPTION OF THE INVENTION

Figure 1:
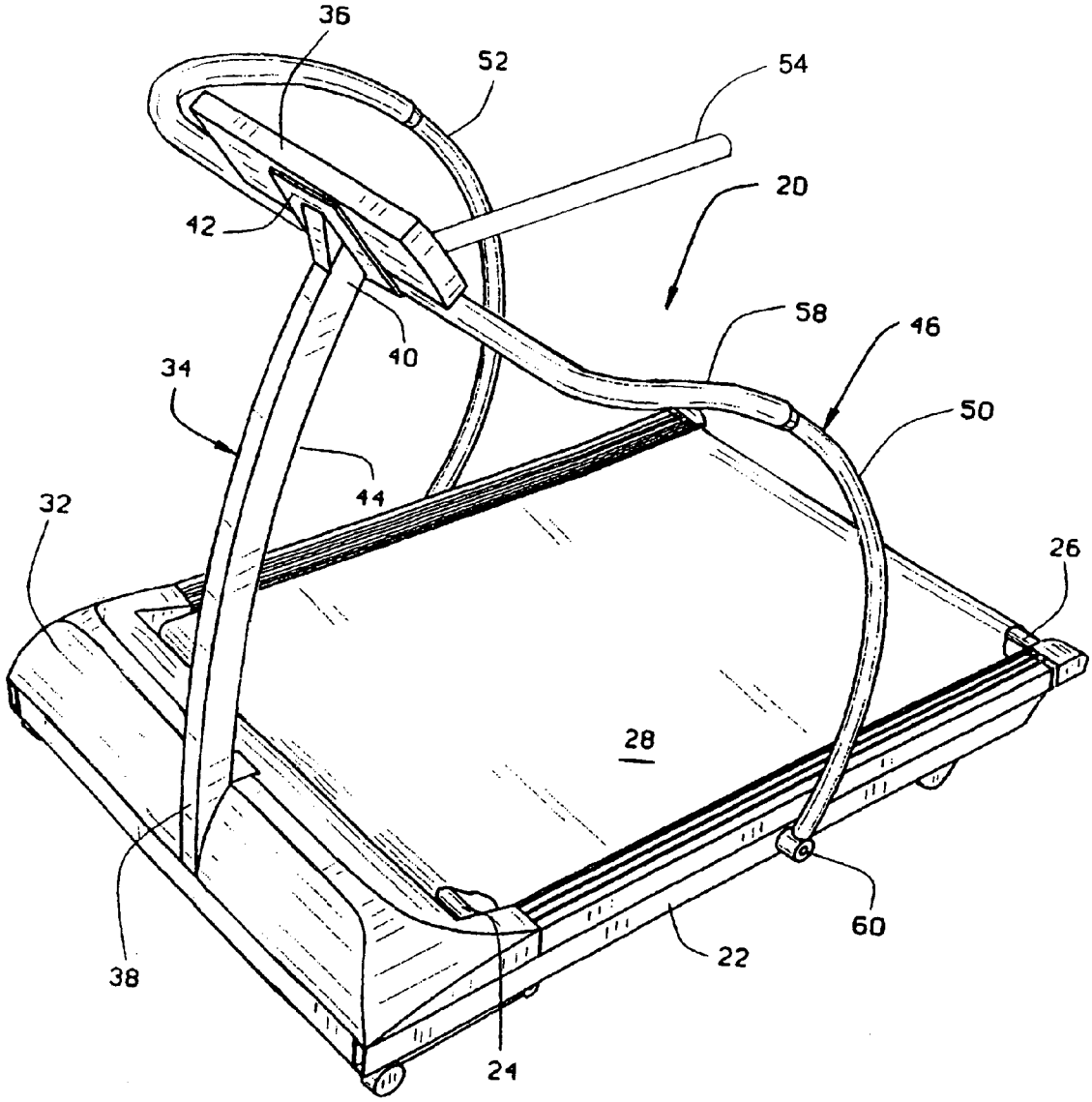
FIG. 1 is a perspective view of one embodiment of a treadmill of the present invention with portions broken away to show detail.

In the present invention, two treadmill users are positioned side-by-side when they are in a position where, for example, they can hold hands (if the two treadmill users are people) or a human treadmill user can walk beside a dog.

In one embodiment of the present invention, the treadmill includes a base, a pair of parallel, spaced rollers rotatably disposed in the base, and an endless belt extending around both rollers, wherein the belt has a width which is large enough to accommodate two treadmill users side-by-side. One of the rollers is powered by a suitable motor to rotate the roller, thereby moving the belt with the rollers. The belt includes an upper portion which extends between the rollers and which provides a surface upon which two users can walk or run. A forward post or posts can extend up from the base for supporting a control panel and/or a handle bar. The control panel typically has controls for turning the treadmill on and off and for varying the speed of the belt and sometimes the angle of inclination of the belt relative to the ground. Also, it often has indicators for selectively displaying operational information such as speed, distance traveled, time, degree of inclination, etc. One of the users may press a suitable button on the control panel to toggle between two or more different displays.

An important aspect of this embodiment of the present invention is the width of the belt, which must be wide enough to accommodate two treadmill users side-by-side (such as two adult people side-by-side, or an adult person and a dog side-by-side). For example, the belt could be at least 30 inches wide. Preferably, the belt is at least 36 inches wide. More preferably, the belt is at least 45 inches wide where the two treadmill users are people. Still more preferably, the belt is at least 48 inches wide. The belt can be made of any suitable material well known in the art.

In another embodiment of the present invention, the treadmill includes a base, two pairs of parallel, spaced rollers rotatably disposed in the base, and two endless belts, wherein one belt extends around both rollers in one pair of rollers and the other belt extends around both rollers in the other pair of rollers, wherein each belt has a width which is large enough to accommodate one treadmill user, and wherein the two belts are positioned to accommodate two treadmill users side-by-side. One of the rollers in each pair of rollers is powered by a suitable motor to rotate the roller, thereby moving the respective belt with the respective rollers. Each belt includes an upper portion which extends between the rollers and which provides a surface upon which one of the users can walk or run. A forward post or posts can extend up from the base for supporting at least one control panel and/or handle bar. The at least one control panel typically has controls for turning the treadmill on and off and for varying the speed of the belt and sometimes the angle of inclination of the belt relative to the ground. Also, it often has indicators for selectively displaying operational information such as speed, distance traveled, time, degree of inclination, etc. The at least one control panel can be arranged so that at least one of the users may press a suitable button on the control panel to toggle between two or more different displays. Further, the at least one control panel can be arranged so that each user can independently control the speed and degree of inclination for that user's belt.

In this embodiment, the belts can have the same width (e.g., if each belt has a width which is large enough to accommodate an adult person) or different widths (e.g., if one belt has a width which is large enough to accommodate an adult person and the other belt has a width which is large enough to accommodate a dog). For example, a belt in this embodiment could have a width of at least 12 inches (e.g., for a small dog), 16 inches, 18 inches, 20 inches or 24 inches. In a preferred embodiment with two belts, the belts move independently of each other, such that one can be moving at one speed while the other moves at another speed.

The motor(s) used in the present invention must be suitable to rotate the belt(s). For example, the motor(s) could be at least 1.5 horsepower. More preferably, the motor(s) could be 1.75 horsepower, 2.0 horsepower, 2.5 horsepower, 3.0 horsepower, 4.0 horsepower, 5.0 horsepower, or an even higher horsepower. The motor(s) can be of the continuous duty type.

The belt(s) can be inclined with an inclination mechanism or mechanisms used in the art. In a preferred embodiment with two belts, the belts can be inclined independently.

A handle bar which can be used in the present invention can have a front portion and left and right side portions. The front portion is positioned above the upper surface of the endless belt toward the front end of the treadmill. The side portions extend back from the front portion. Each side portion of the handle bar can accommodate a hand of a treadmill user, so that if the two treadmill users are humans positioned side-by-side, the left hand of the person on the left side of the treadmill can grip the left side portion of the handle bar and the right hand of the person on the right side of the treadmill can grip the right side portion of the handle bar, leaving the right hand of the person on the left side of the treadmill free to hold the left hand of the person on the right side of the treadmill.

A middle portion can also be present on the handle bar, wherein the middle portion can extend back from a middle part of the front portion when desired (e.g., when the treadmill users are people who want to have each of their hands on the handle bar rather than holding hands, or when only one treadmill user wishes to use the treadmill and wishes to hold the handle bar with both hands). When the middle portion is not desired (e.g., when the treadmill users wish to hold hands), it can be pivoted so that it hangs down from the front portion, or it can be removed. If a middle portion is not present at all in an embodiment of the present invention and a lone treadmill user wishes to walk or run on a particular part of the treadmill, the left side portion and/or the right side portion could be moved along the front portion and fastened in an appropriate position.

In the event that one of the treadmill users is an animal such as a dog, a harness could be attached to the treadmill, such as is described in U.S. Pat. No. 6,058,888, the disclosure of which is incorporated herein by reference.

A treadmill of the present invention can be made in a manner similar to that in which treadmills are presently made, except that, e.g., a wider belt or two belts would be used. In view of the disclosure in this specification, it is considered that one of ordinary skill in the art would understand how to make the present invention.

A treadmill of the present invention can be used by two treadmill users positioned side-by-side by (1) providing a treadmill comprising a base, a pair of parallel, spaced rollers rotatably disposed in the base, and an endless belt extending around both rollers, wherein the belt has a width which is large enough to accommodate the two treadmill users side-by-side, and (2) moving the belt to exercise the two treadmill users.

Also, a treadmill of the present invention can be used by two treadmill users positioned side-by-side by (1) providing a treadmill comprising a base, two pairs of parallel, spaced rollers rotatably disposed in the base, and two endless belts, wherein one belt extends around both rollers in one pair of rollers and the other belt extends around both rollers in the other pair of rollers, wherein each belt has a width which is large enough to accommodate one of the treadmill users, and wherein the two belts are positioned to accommodate the two treadmill users side-by-side, and (2) moving the belts to exercise the two treadmill users.

Referring now to FIG. 1, a treadmill of the present invention is indicated in its entirety by the reference numeral 20. The treadmill includes a base 22, a forward roller 24, a rear roller 26, an endless belt 28 having a width suitable to accommodate two treadmill users, and a support deck (not shown). The support deck is supported by the base 22 in a generally horizontal position, unless inclination is provided whereby the base and support deck deviate from the horizontal position. The forward and rear rollers 24, 26 are journalled in the base 22 for rotation about parallel forward and rear axes. The forward roller 24 is spaced slightly forward of the support deck and the rear roller 26 is spaced slightly rearward of the support deck. The endless belt 28 surrounds the support deck and is entrained around the rollers 24, 26. An upper reach of the belt 28 extends between the rollers 24, 26 and over the support deck. The upper reach is the surface upon which the users walk or run. The forward roller 24 is rotated by a suitable motor (not shown) preferably positioned forward of the forward roller to rotate the belt in a manner to cause the upper reach to move rearwardly. The motor is preferably covered by a motor shroud 32 positioned forward of the forward roller.

A forward post or posts, generally indicated at 34, extends up from the base 22 for supporting a control panel 36. The control panel 36 preferably has controls for controlling and monitoring several of the treadmill's functions. To simplify the drawings, the control panel 36 is shown schematically without controls and indicators. However, it is to be understood that the control panel actually has controls and indicators. The post 34 has a lower end margin 38 and an upper end margin 40. The lower end margin 38 is connected to the base 22 via suitable fasteners (not shown) and is spaced forward of the forward roller 24 and generally adjacent to the motor shroud 32. A support plate 42 can be welded or otherwise secured to the upper end of the upper end margin 40 of the post. The post 34 can have a bend extending from its lower end margin to its upper end margin. The bend of the post 34 can have a concave surface portion 44 facing generally rearwardly and extending from the lower end margin 38 to the upper end margin 40. Preferably, the concave surface portion 44 extends from the lower end of the lower end margin 38 to the upper end of the upper end margin 40.

The treadmill 20 further includes a handle bar 46 having a central upper portion 58 and first (left) and second (right) side portions 50, 52. The upper portion 58 of the handle bar 46 is attached to the support plate 42 via a suitable threaded fastener (not shown). Thus, the upper portion 58 of the handle bar 46 is positioned generally adjacent to the upper end margin 40 of the post 34. The side portions 50, 52 of the handle bar 46 extend from the upper portion 58 to the base 22 and have lower ends connected to the base on opposite sides of the upper reach of the endless belt 28 and generally between the forward and rear rollers 24, 26 (i.e., forward of the rear roller and rearward of the forward roller). Preferably, the upper portion 58 and at least part of the side portions 50, 52 include a resilient polymeric material as a hand grip. The handle bar 46 optionally includes a middle portion 54.

For compact storage and shipping, the post 34 is preferably pivotally connected to the base 22 for movement of the post between an upright position as shown in the Figure and a stowed position (not shown) in which the control panel 36 is positioned adjacent to the upper reach of the belt 28. Also, the handle bar 46 is pivotally connected at 60 to the base 22 for movement between an upright position (shown in the Figure) and a stowed position (not shown) in which the upper portion 58 of the handle bar is positioned forward of the motor shroud 32. When in their upright positions, the upper portion 58 of the handle bar 46 is secured via suitable fasteners to the support plate 42 so that the handle bar in part supports and stabilizes both the post 34 and control panel 36. The post 34 is further locked in its upright position by a suitable threaded fastener (not shown) connecting the lower end margin of the post to the base. With the post 34 and handle bar 46 in their upright position, the treadmill 20 is ready for use.

Figure 2:
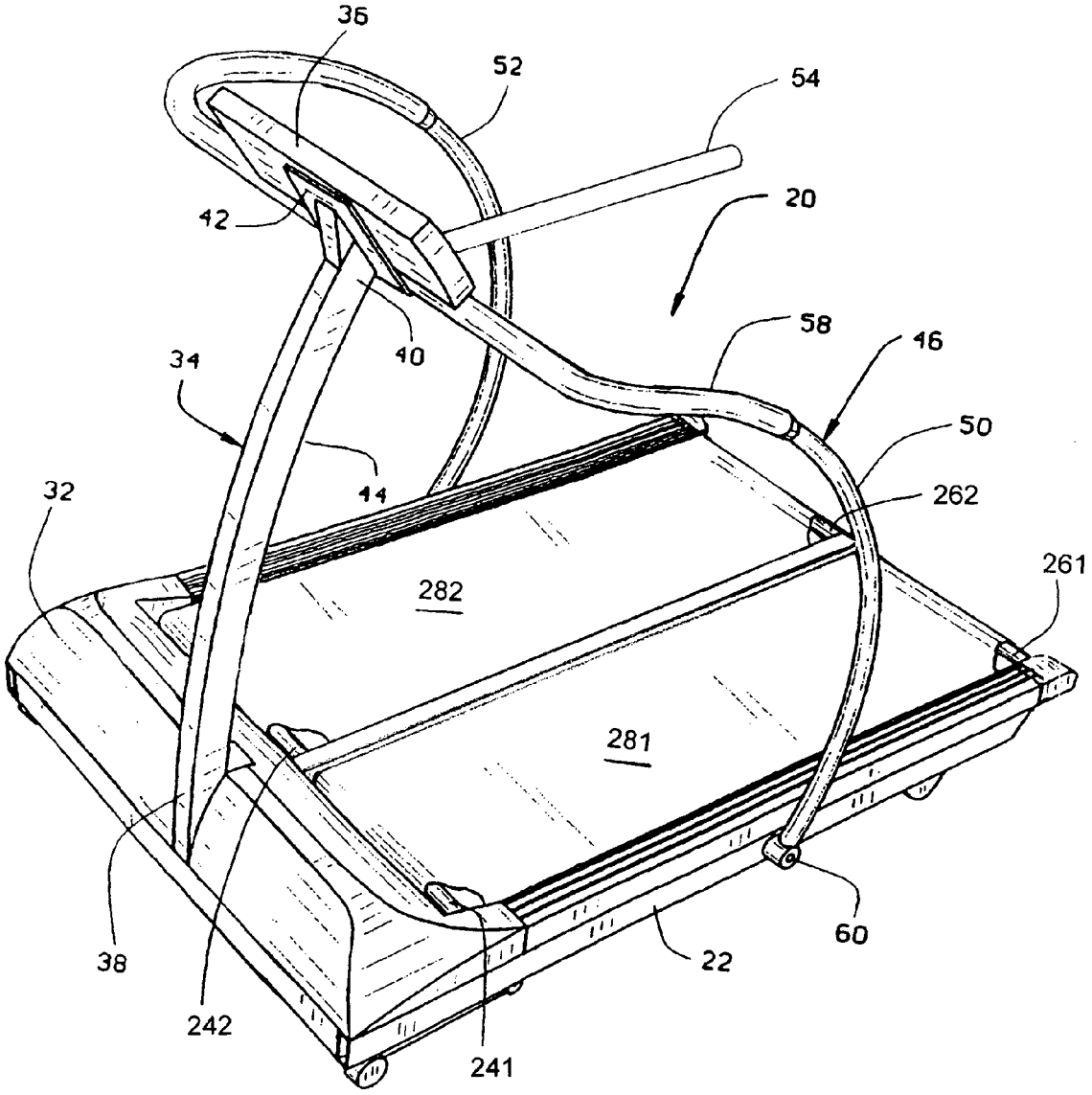
FIG. 2 is a perspective view of another embodiment of a treadmill of the present invention with portions broken away to show detail.

Another embodiment of the present invention is shown in FIG. 2, in which the treadmill 20 includes a base 22, a pair of forward rollers 241 and 242, a pair of rear rollers 261 and 262, a pair of endless belts 281 and 282 each having a width suitable to accommodate a treadmill user, and a support deck (not shown).

While the invention has been described in detail and with reference to specific embodiments thereof, it will be apparent to one of ordinary skill in the art that various changes and modifications can be made therein without departing from the spirit and scope thereof.

What is claimed is:

1. A treadmill comprising a base, two pairs of parallel, spaced rollers rotatably disposed in the base, and two endless belts, wherein one belt extends around both rollers in one pair of rollers and the other belt extends around both rollers in the other pair of rollers, wherein each belt has a width which is large enough to accommodate one treadmill user, and wherein the two belts are positioned to accommodate two treadmill users side-by-side, wherein each belt has a width which is large enough to accommodate an adult person.

2. A treadmill as claimed in claim 1, wherein the belts move independently of each other.

3. A treadmill as claimed in claim 2, wherein the belts can be inclined independently of each other.

4. A treadmill as claimed in claim 1, wherein the treadmill has a handle bar comprising a front portion and left and right side portions, wherein the handle bar further comprises a middle portion which can extend back from a middle part of the front portion.

5. A method for two treadmill users to exercise side-by-side on a single treadmill, comprising providing a treadmill comprising a base, two pairs of parallel, spaced rollers rotatably disposed in the base, and two endless belts, wherein one belt extends around both rollers in one pair of rollers and the other belt extends around both rollers in the other pair of rollers, wherein each belt has a width which is large enough to accommodate one treadmill user, and wherein the two belts are positioned to accommodate two treadmill users side-by-side, wherein each belt has a width which is large enough to accommodate an adult person, and moving the belts to exercise two treadmill users positioned side-by-side on the belts.

6. A method as claimed in claim 5, wherein the belts move independently of each other.

7. A method as claimed in claim 6, wherein the belts can be inclined independently of each other.

8. A method as claimed in claim 5, wherein the treadmill has a handle bar comprising a front portion and left and right side portions, wherein the handle bar further comprises a middle portion which can extend back from a middle part of the front portion.

* * * * *